US010718124B1

(12) United States Patent
Blanco

(10) Patent No.: US 10,718,124 B1
(45) Date of Patent: Jul. 21, 2020

(54) CONCRETE FORM TIE ROD PULLER

(71) Applicant: Rolando Blanco, Hialeah, FL (US)

(72) Inventor: Rolando Blanco, Hialeah, FL (US)

( * ) Notice: Subject to any disclaimer, the term of this patent is extended or adjusted under 35 U.S.C. 154(b) by 0 days.

(21) Appl. No.: 16/444,104

(22) Filed: Jun. 18, 2019

(51) Int. Cl.
*E04G 17/075* (2006.01)
*E04G 17/06* (2006.01)

(52) U.S. Cl.
CPC ..... *E04G 17/0754* (2013.01); *E04G 17/0642* (2013.01)

(58) Field of Classification Search
CPC ... E04G 17/06; E04G 17/0642; E04G 17/075; E04G 17/0751; E04G 17/0752; E04G 17/0754; E04G 17/0755; E04G 17/0757; E04G 17/0758
USPC .. 249/40, 41, 42, 43, 45, 46, 191, 214, 216; 254/29 A, 29 R, 31
See application file for complete search history.

(56) References Cited

U.S. PATENT DOCUMENTS 825,183 A * 7/1906 Bovee ..... E04G 11/28 249/20
1,782,897 A * 11/1930 Hudgin ..... E04G 17/0658 249/216
2,004,462 A * 6/1935 Bush ..... E04G 11/12 249/42
2,190,748 A * 2/1940 Williams ..... E04G 17/0658 249/217
2,270,035 A * 1/1942 Colt ..... E04G 17/0658 249/42
2,281,833 A * 5/1942 De Canio ..... E04G 17/0658 249/217
3,060,541 A * 10/1962 Hillberg ..... E04G 17/0721 249/190
3,464,667 A * 9/1969 Sledz ..... E04G 9/10 249/190
3,633,867 A * 1/1972 Eriksson ..... E04G 17/0642 249/213
3,685,934 A * 8/1972 Huber ..... E04C 5/122 425/111
3,910,546 A * 10/1975 Connors ..... E04G 17/0721 249/40

(Continued)

FOREIGN PATENT DOCUMENTS

JP 01187262 A * 7/1989
JP 01198971 A * 8/1989

(Continued)

*Primary Examiner* — Michael Safavi
(74) *Attorney, Agent, or Firm* — Sanchelima & Associates, P.A.; Christian Sanchelima; Jesus Sanchelima

(57) ABSTRACT

A tie rod puller including a pull housing, a clutch assembly and a clutch assembly housing is disclosed. The tie rod puller accelerates the process of pulling tie rods and installing key plates. The pulling of tie rods better secures the panels of a structure under construction to improve the integrity of a structure. The clutch assembly movably rotates a nut as a tie rod is being installed. The clutch assembly includes a stopper to prevent the nut from moving too far back. The clutch assembly is to hold and move a tie rod upon pulling of the tie rod and installing a key plate onto a wall. The clutch assembly housing includes a plate, which receives a key plate with a magnet. The plate includes brackets to stabilize the tie rod puller. The tie rod puller is preferably operated by automatic means such as by an impact drill.

13 Claims, 7 Drawing Sheets

(56) References Cited

U.S. PATENT DOCUMENTS

| | | | | | |
|---|---|---|---|---|---|
| 4,044,986 | A * | 8/1977 | Strickland | E04G 17/0657 | 249/216 |
| 4,058,285 | A * | 11/1977 | Walski | E04G 17/0651 | 249/216 |
| 4,068,818 | A * | 1/1978 | Gates | E04G 17/0742 | 249/190 |
| 4,158,452 | A * | 6/1979 | Gates | E04G 17/047 | 249/191 |
| 4,192,215 | A * | 3/1980 | Hymans | E04C 5/122 | 24/122.6 |
| 4,231,541 | A * | 11/1980 | Strickland | E04G 17/0714 | 249/216 |
| 4,254,932 | A * | 3/1981 | Durbin | E04G 11/12 | 249/18 |
| 4,426,061 | A * | 1/1984 | Taggart | E04B 2/8605 | 249/191 |
| 5,282,603 | A * | 2/1994 | Taraldsson | E04G 17/075 | 249/35 |
| 5,594,977 | A | 1/1997 | McCallion | | |
| 5,762,815 | A * | 6/1998 | Lee | E04G 17/065 | 249/155 |
| 6,539,591 | B1 | 4/2003 | Blanco | | |
| 7,819,388 | B2 * | 10/2010 | McCallion | E02D 5/808 | 24/136 B |

FOREIGN PATENT DOCUMENTS

| | | | | |
|---|---|---|---|---|
| JP | 04203163 A | * | 7/1992 | |
| JP | WO2016027339 | * | 4/2017 | E04G 17/065 |
| KR | 10-0572399 | * | 4/2006 | E04G 17/075 |

* cited by examiner

CONCRETE FORM TIE ROD PULLER

BACKGROUND OF THE INVENTION

1. Field of the Invention

The present invention relates to a construction tool and, more particularly, to a construction tool that includes a tie rod puller to facilitate tie rod and key plate installation onto concrete forms.

2. Description of the Related Art

Several designs for tie rod pullers have been designed in the past. None of them, however, include an extraction assembly having means to slidably journal generally within a housing where the housing has a movable plate assembly at one end.

Applicant believes that a related reference corresponds to U.S. Pat. No. 5,594,977 issued to McCallion for Smooth Rod-Gripping Apparatus. However, it differs from the present invention because the McCallion's apparatus works strictly for gripping a smooth fiberglass rod. The apparatus comprising a housing, a jaw cluster within the housing, and a force tube for positioning the jaw cluster within the housing. The rod-gripping apparatus includes a first aperture and a second aperture, which facilitate passage of a rod through the apparatus. The force tube is mechanically interfitted with the jaw cluster. The jaw cluster comprises a plurality of elongated jaw members, which are generally wedge shaped, and complementary to an inner tapered wall of the housing. The jaw cluster, which surrounds the rod, is set to or released from the rod, as desired, in response to a repositioning of the force tube relative to the housing. Therefore, McCallion's invention involves the use of an apparatus for gripping a smooth fiberglass rod, whereas the present invention provides for the mounting of a key plate thereon, thereby facilitating its installation after a tie rod has been pulled by said present invention.

Applicant believes that an additional related reference corresponds to U.S. Pat. No. 6,539,591 issued to Rolando Blanco for a tie rod puller. The tie rod puller of is a construction tool that facilitates tie rod and key plate installation onto concrete forms, it primarily comprises a housing and an extraction assembly. The extraction assembly has means to slidably journal generally within the housing. The housing has a movable plate assembly at one end that has a protrusion outwardly extending therefrom. The protrusion is uniquely shaped to mount a key plate thereon. The prior art of Blanco however has room for improvement. The present invention does not use a protrusion to mount a key plate thereon, instead a magnet is used. The prior art was also only operable via manual means, while the present invention has improved on that limitation as it can be operated via both manual and automatic means. There is also fewer separate components in the present invention. The present invention has a clutch assembly that allows the tie rod puller to operate and it is significantly distinct from the cited reference. The clutch assembly has a stopper not previously seen, which prevents over spinning of the construction tool upon installation or removal of a tie rod. The connections between components of the present invention can mostly be achieved through soldering. While the cited reference and the present invention accomplish similar goals, the present invention makes significant improvements over the art of Blanco.

Other documents describing the closest subject matter provide for a number of more or less complicated features that fail to solve the problem in an efficient and economical way. None of these patents suggest the novel features of the present invention.

SUMMARY OF THE INVENTION

A construction tool, comprising a housing assembly having a first and second end. The first end has an end cap with an opening wherein a square socket adapter or a ratchet wrench is inserted into. The second end has at least two brackets mounted thereon and a plate. The brackets are at opposite sides of said plate. The housing having movable means to move said plate. The plate has a groove and further has a magnet to receive and hold a key plate.

It is one of the objects of the present invention to facilitate withdrawal of a tie rod from a concrete form.

It is another object of this invention to provide an apparatus to pull a tie rod to enable a user to safely place a key plate there on.

It is still another object of the present invention to provide a safe and efficient tie rod puller that may be utilized by the user through manual or automatic means.

It is still another object of the present invention to provide a tie rod puller that may temporarily extract a tie rod sufficiently to place a key plate thereon.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
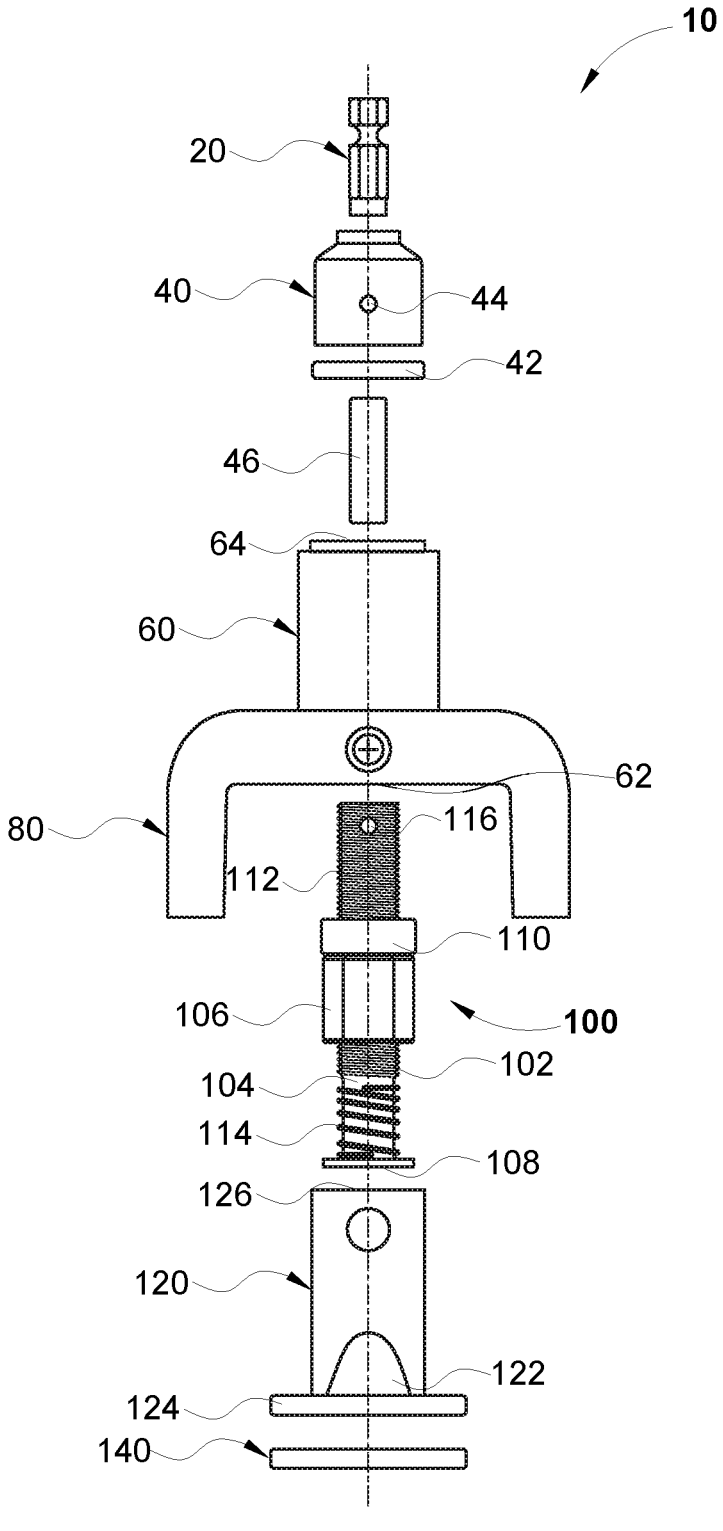
FIG. 1 is an exploded view of the tie rod puller.

Referring now to the drawings, where the present invention is generally referred to with numeral 10, it can be observed that the tie rod puller 10 basically includes a pull housing 60 containing a clutch assembly housing 120, a clutch assembly 100, brackets 80 on a distal end, a key plate 140, a threaded screw receiver 40 and a socket adapter 20 adapted to receive a drill D such as an impact drill on an opposite distal end.

FIG. 1 illustrates an exploded view of the tie rod puller 10. There can be seen the various working parts of the tie rod puller 10. It can be seen that the present invention includes a socket adapter 20, wherein the socket adapter 20 may be attached to a screw receiver 40. The screw receiver 40 may receive a threaded screw. The screw receiver 40 includes a spring tension pin hole 44 adapted to receive a spring tension pin 46, which is adapted to hold certain assemblies of the tie rod puller 10 together when the tie rod puller 10 is fully assembled. There is also a pull housing 60 which has an opening on each of both distal ends, further defined as a first opening 62 and a second opening 64. It can also be seen that the present invention includes a clutch assembly 100. The clutch assembly 100 may be housed within the clutch assembly housing 120. The clutch assembly housing 120 further includes a clutch assembly housing opening 126 on one distal end to receive the clutch assembly 100 and a plate 124 mounted on the opposite distal end. There is also a top opening 122 found on the top of the clutch assembly housing 120 which can be used to see part of the clutch assembly 100. The clutch assembly 100 may include a screw 102 having a threaded portion 112 and a smooth portion 104. Screw 102 may also include a clutch assembly spring tension pin hole 116 to receive spring tension pin 46 when the tie rod puller is fully assembled. The first opening 62 of pull housing 60 may receive the clutch assembly housing 120 with the clutch assembly 100 housed therein. The second opening 64 of the pull housing 60 may be where the threaded portion 112 of screw 102 exits from as the screw 10 is greater in length than the pull housing 60. The protruding threaded portion 112 may then be received by the screw receiver 40. The screw receiver 40 has inner treads to receive the threaded portion 112 of the screw 102. There may also be a washer 42 which slightly separates the screw receiver 40 from the pull housing 60, when the tie rod puller 10 is fully assembled. The washer 42 prevents damage to components of the tie rod puller 10, more specifically to the screw receiver 40 and the pull housing 60 from damage that may result from overtightening or overspinning when operating the tie rod puller 10. Thereby, washer 42 may help to make the tie rod puller 10 more durable. The pull housing 60 further includes brackets 80. The brackets 80 may preferably be in a "U" shape. The brackets 80 can be mounted to the pull housing 60. The brackets 80 can be mounted to the pull housing 60 via a fastener 82. However, it should be appreciated that the brackets 80 are not limited to being attached to the pull housing via a fastener 82, other means such as by soldering or any other means may be suitable as well. Brackets 80 can be opposite to one another. The brackets 80 are located adjacent to the periphery edges of the plate 124 mounted to the clutch assembly housing 120 when the tie rod puller is fully assembled. The brackets 80 can be perpendicular to a wall W when the tie rod puller 10 is being operated. The brackets 80 can help to stabilize use of the tie rod puller 10. Thereby allowing a user to efficiently and safely operate the tie rod puller 10. The last component of the tie rod puller 10 seen in FIG. 1 is the key plate 140. It should be known that the tie rod puller 10 and all corresponding components can be of any predetermined size as per the needs of a user. The tie rod puller 10 can also be made of any suitable material such as metal, steel, aluminum or the likes as known in the art.

Figure 2:
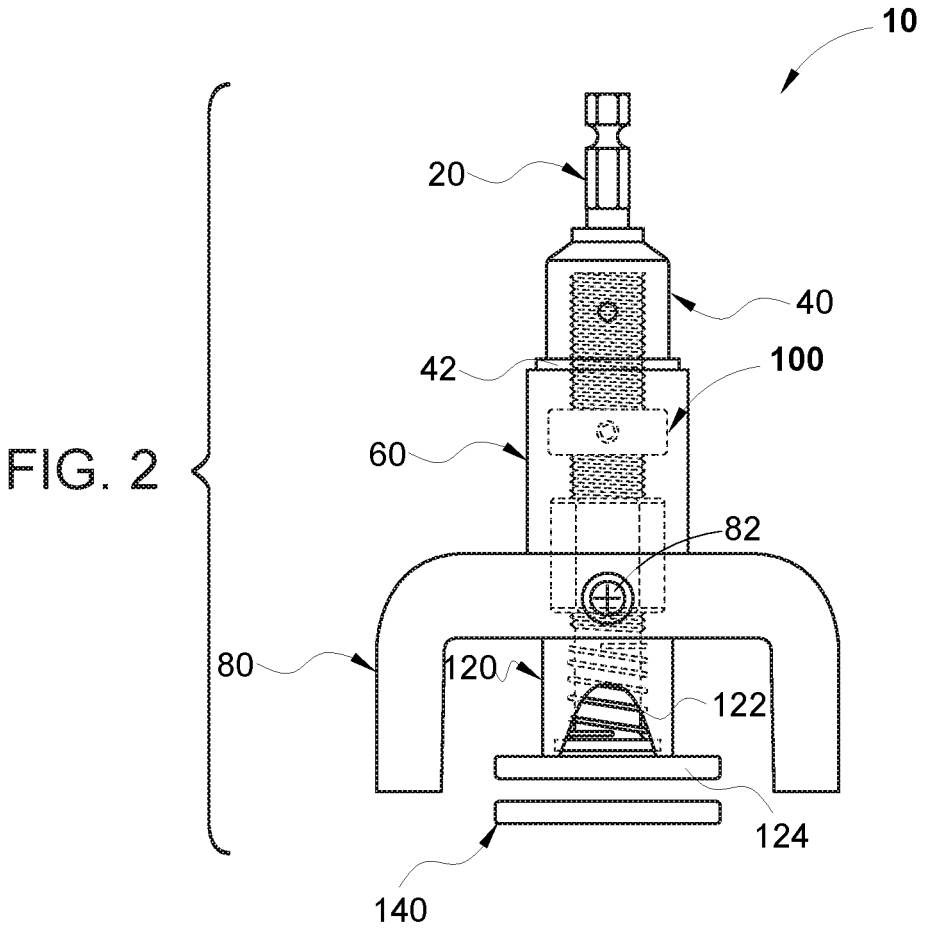
FIG. 2 is a top view of the tie rod puller fully assembled.

FIG. 2 illustrates the tie rod puller 10 in a fully assembled configuration. It can be seen that the clutch assembly 100 is partly housed within the clutch assembly housing 120, wherein the clutch assembly housing 120 is partially housed within the pull housing 60. It can also be seen that a portion of the clutch assembly 100, more specifically the threaded portion 112, is engaged by the screw receiver 40 once the tie rod puller 10 has been fully assembled. When the tie rod puller 10 is fully assembled spring tension pin 46 may be inserted into the spring tension pin hole 44 and clutch assembly spring tension pin hole 116. Thereby holding together the screw receiver 40 and the clutch assembly 100 together. The plate 124 which may receive the key plate 140 is seen as well.

Figure 3:
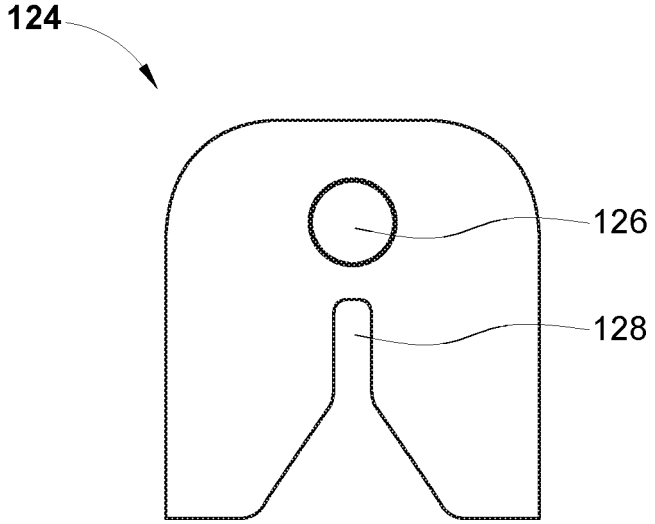
FIG. 3 illustrates a front view of the plate that holds the key plate with a magnet.
Figure 4:
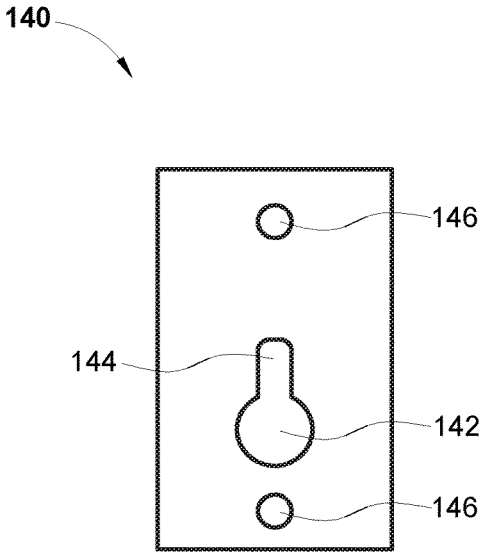
FIG. 4 illustrates a front view of a key plate.
Figure 7:
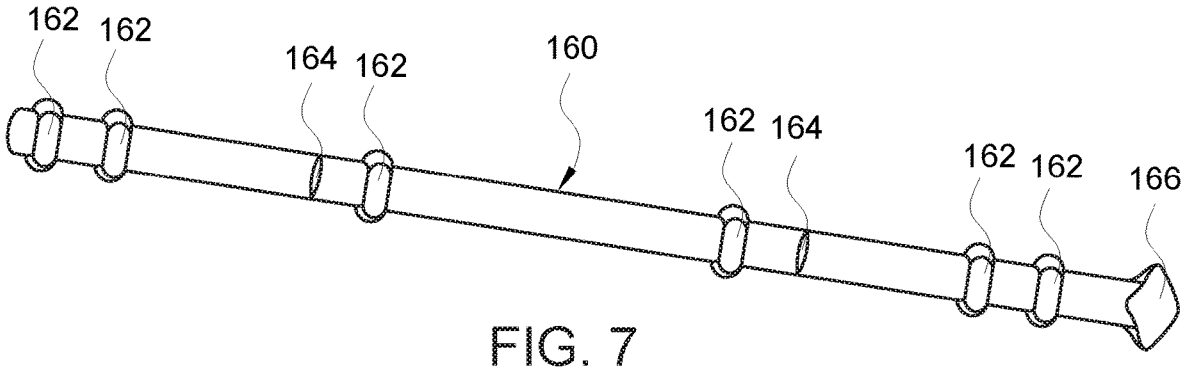
FIG. 7 illustrates a tie rod.

FIG. 3 shows a front view of the plate 124 that is found on one distal end of the clutch housing assembly 120. The plate 124 may include a magnet 126. The magnet 126 may be used to hold a key plate 140 in place when the tie rod puller 10 is being operated. The magnet 126 holds the key plate 140 until the key plate 140 has been engaged by a tie rod 160 and thereby being mounted to a wall W. The plate 124 also has a tie rod slot 128, wherein a tie rod 160 slides into place when the tie rod puller 10 is being used. FIG. 4 shows the key plate 140 which is to be mounted to a wall W. The key plate 140 has nail holes 146 in which nails 148 are to be inserted into. The nails 148 further secure the key plate 140 to the wall W once the tie rod 160 has been inserted into a wall W. The key plate 140 can have a hole 142 which allows a tie rod 160 to be inserted therethrough. There is also a slot 144 found on hole 142, which can receive and securely hold in a place a tie rod 160. The tie rod 160 that can be used with the tie rod puller 10 is seen in FIG. 7. The tie rod 160 can have at least one notch such as notches 162, one of which is to slide into the slot 144 of hole 142 of one key plate 140 found on one side of wall W. While another one of the notches 162 at the distal end of the tie rod 160 slides into the slot 144 of hole 142 found on another one of key plate 140 on an opposite side of another wall W. The tie rod 160 can additionally have a bit portion 166 which allows the tie rod 160 to easily penetrate walls. Thereby allowing the tie rod 160 to penetrate both sides of a wall, until the key plate 140 is secured in place by nails 148. The tie rod 160 may also include weakened portions 164 which may be used to break off the distal ends of the tie rod 160 in order to leave the remaining portion of the tie rod 160 secured into a wall.

Figure 5:
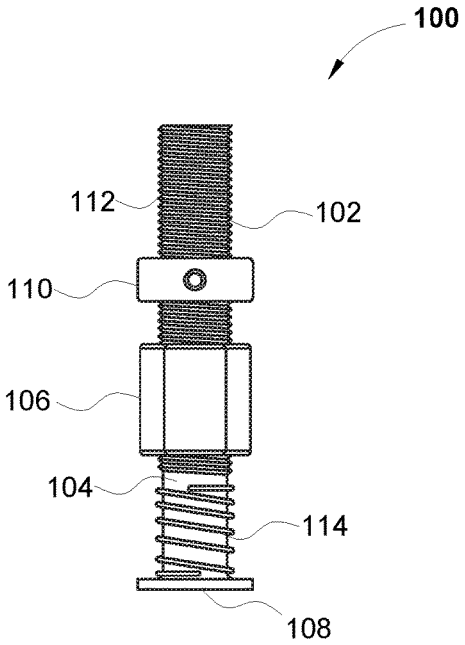
FIG. 5 is a zoomed in view of the clutch assembly found within the tie rod puller housing which engages and disengages tie rods.
Figure 6:
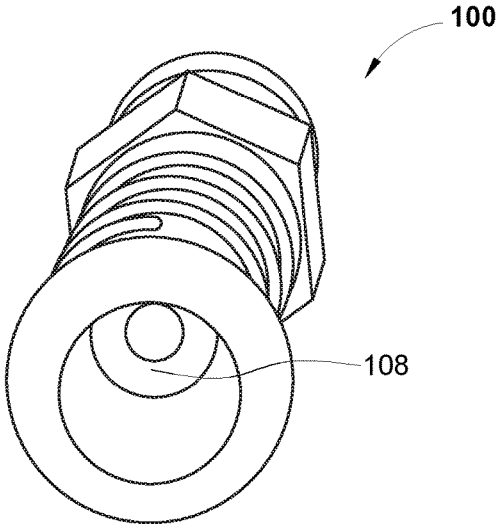
FIG. 6 illustrates an opening found on the clutch assembly of the tie rod puller adapted to receive a tie rod.

FIG. 5 and FIG. 6 provide a zoomed in view of the clutch assembly 100. The clutch assembly may include a screw 102, the screw 102 may have a threaded portion 112 on which a stopper 110 and a nut 106 are mounted thereon. The stopper 110 may be on a predetermined fixed location on the threaded portion 112 of screw 102. The nut 106 is moveably attached on the screw 102 on the threaded portion 112 as it is intended to move up and down screw 102 as the tie rod puller 10 is being operated. The nut 106 can only go so far back as the location of stopper 110 as stopper 110 prevents the nut 106 from moving beyond a certain point on the screw 102. There may also be a spring 114 that is mounted about the circumference of the smooth portion 104 of the screw 102. The spring 114 may be compressed as the nut 106 moves towards the smooth portion 104 of the screw 102. The spring 114 may expand as nut 106 moves towards the stopper 110 mounted on the threaded portion 112 of the screw 102. Once nut 106 has made it to the smooth portion 104 of the screw 102, it may compress the spring 114 and then nut 106 will freely rotate. This serves as a safety measure as it prevents any function other than the nut 106 spinning freely. Thereby a user cannot over spin the screw 102. The compression or expansion of the spring 114 occurs as the tie rod puller 10 is being operated. Thereby meaning that a tie rod, like tie rod 160 is being mounted to a wall W or extracted from a wall W. The clutch assembly 100 can also include an opening 108 on its bottom as seen in FIG. 6. The opening 108 is meant to receive a tie rod 160. The opening 108 helps to maintain the tie rod 160 stable and secure in the tie rod puller 10 until the tie rod 160 is pulled from a wall W.

Figure 8:
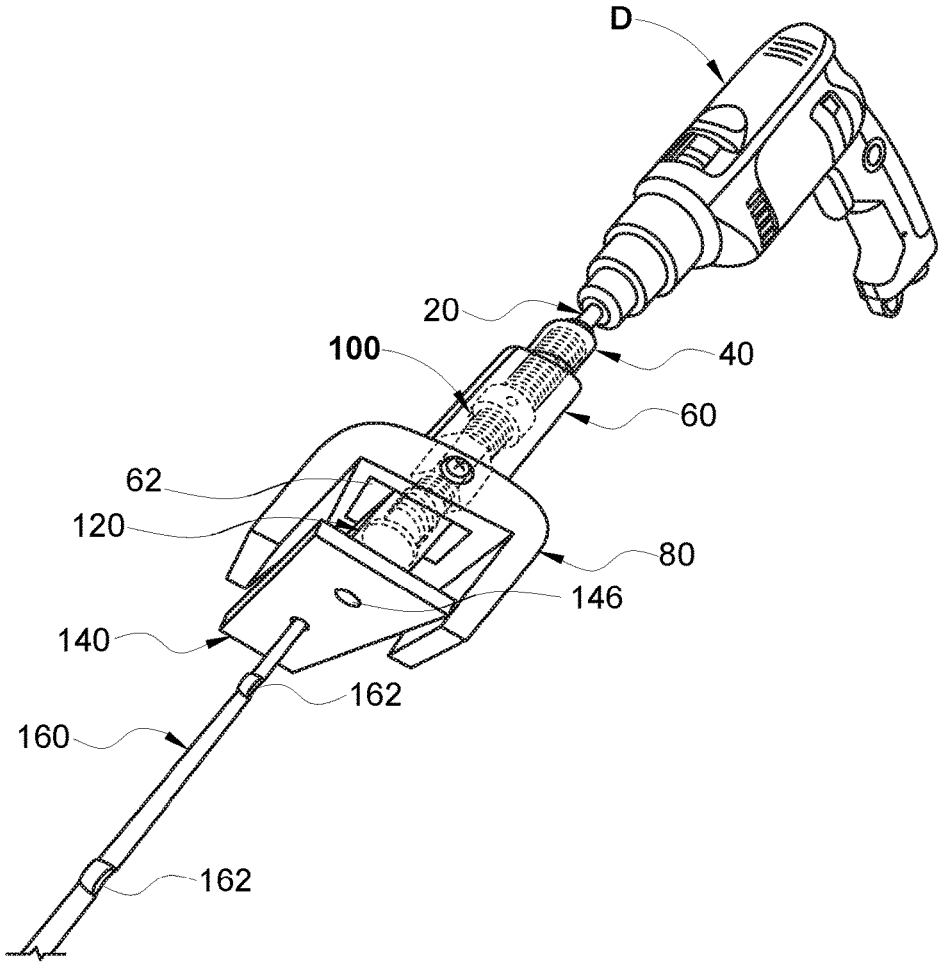
FIG. 8 is an isometric view of the tie rod puller with a tie rod attached to be operated by automatic means more specifically by a drill preferably such as an impact drill.
Figure 8A:
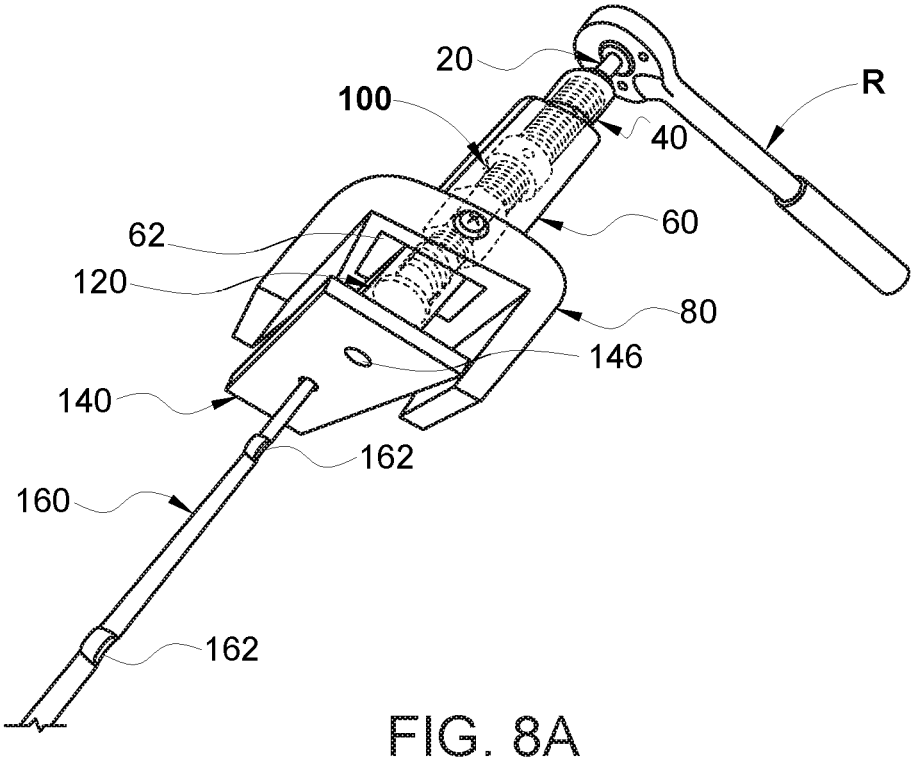
FIG. 8A is an isometric view of the tie rod puller with a tie rod attached to be operated by manual means more specifically by a ratchet.
Figure 9:
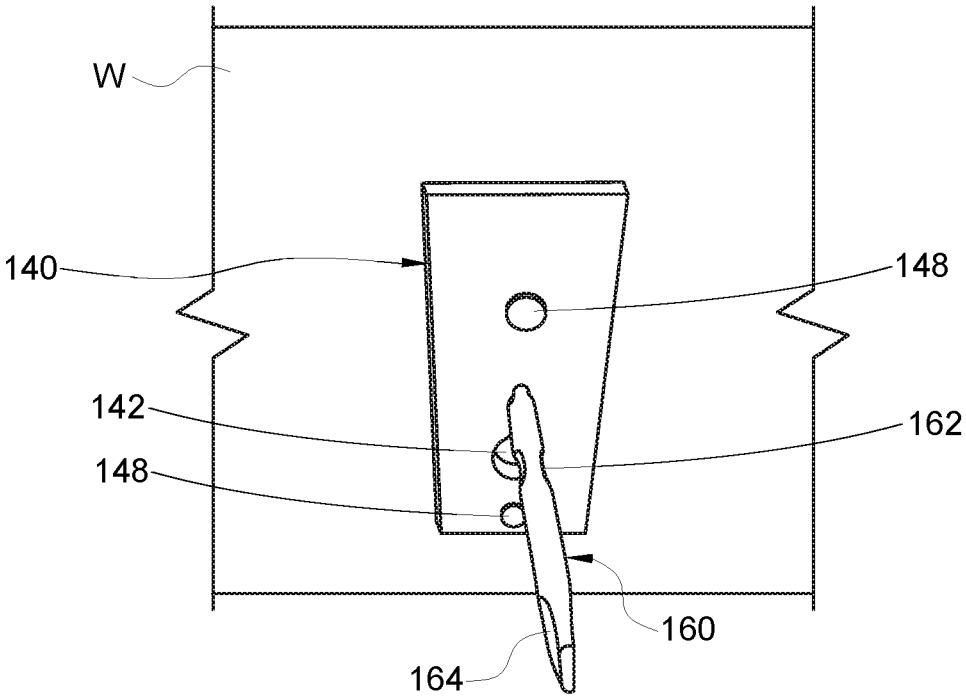
FIG. 9 illustrates a tie rod and a key plate that have already been secured into a wall.

FIG. 8 shows the tie rod puller 10 in an operational configuration ready to be used. The tie rod puller 10 can be operated by automatic means such as with a drill D, preferably with an impact drill, as can be seen in FIG. 8. The tie rod puller 10 can also be operated by manual means such as with a manual drill or a ratchet R as can be seen in FIG. 8A. The automatic means may be preferred as automatic means make operation of the tie rod puller 10 quicker and safer. However, both methods of operating result in the tie rod 160 being pulled and later secured by a key plate 140. FIG. 9 illustrates the result of using the tie rod puller 10. The key plate 140 has been attached to a wall W with the help of the tie rod 160 and the tie rod puller 10. The key plate 140 is then nailed to the wall W with nails 148. The tie rod 160 can then be broken at the weakened portions 164. The remaining portion of the tie rod 160 gets left in the wall W. In the case that the tie rod 160 needs to be removed then operation can still be automatic or manual in that case, but the drill D whether impact drill or not, for example, is just made to rotated in a counter clock wise direction than when it was inserted into the wall W.

Figure 10:
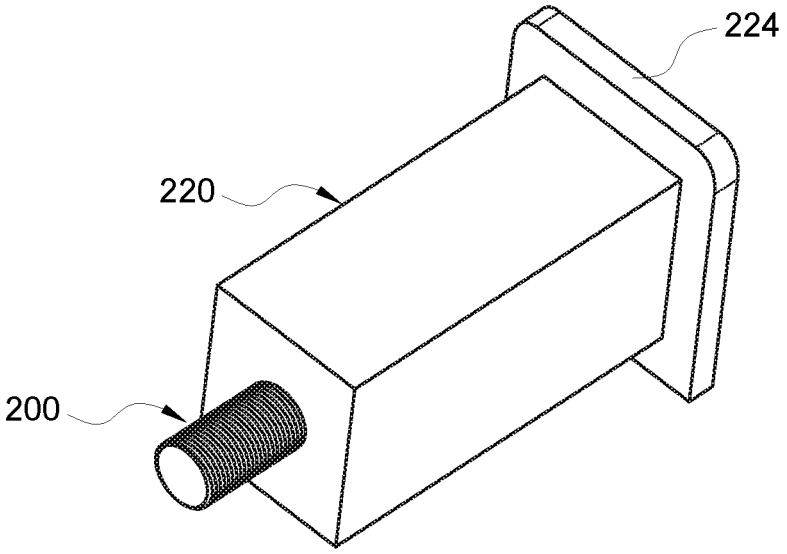
FIG. 10 illustrates an isometric view of the clutch assembly housing in an alternate embodiment.
Figure 10A:
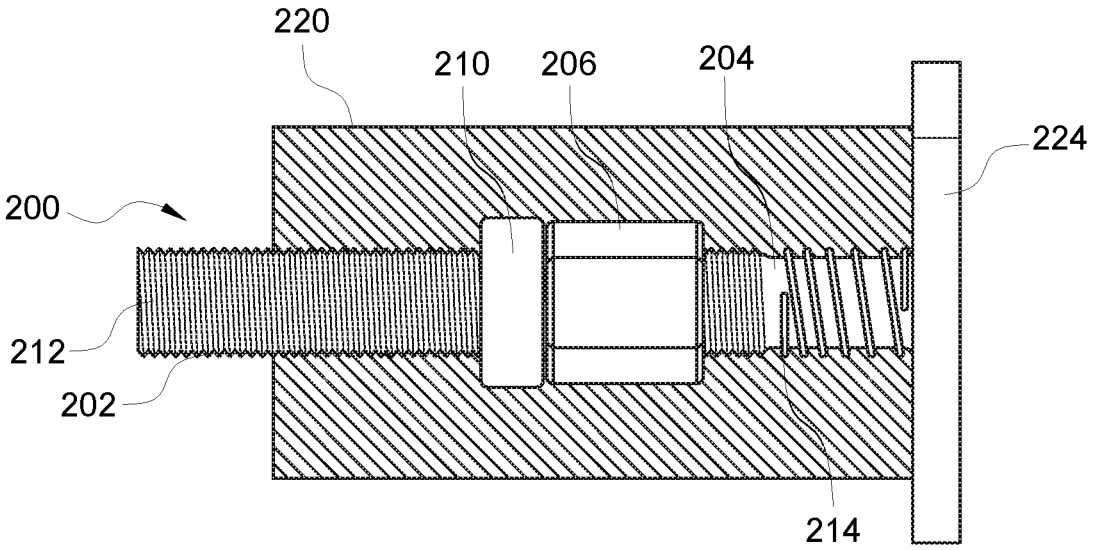
FIG. 10A is a cross sectional view of the clutch assembly housing in an alternate embodiment in which the clutch assembly is integrated into the clutch assembly housing.

FIG. 10 and FIG. 10A illustrate an alternate embodiment for the clutch assembly 200 and the clutch assembly housing 220. In this alternate embodiment the clutch assembly 200 is integrated into the clutch assembly housing 220. Thereby meaning that the clutch assembly 200 may not be removable from the clutch assembly housing 220 in this embodiment as they are one component. This may be beneficial as there would be less parts to manufacture and assemble. In FIGS. 10 and 10A it can be seen that the clutch assembly 200 extends partially outside of the clutch assembly housing 220 in order to be received by screw receiver 40. Even though the clutch assembly 200 is integrated into the clutch assembly housing 220 all parts and components of the clutch assembly 200 may still move as desired in order to allow pulling of a tie rod such as tie rod 160. The clutch assembly 200 may include a screw 202, which may have a smooth portion 204 and a threaded portion 212. Additionally, the clutch assembly 200 may have a nut 206 and a stopper 210 mounted on the threaded portion 212 of the screw 202. The nut 206 may move up and down the screw 202 when the tie rod puller 10 is being operated, but only as far back as where the stopper 210 may be positioned on the screw 202. The stopper 210 may be positioned at a predetermined location on the screw 202. There may also be a spring 214 that is mounted about the circumference of the smooth portion 204 of the screw 202. The spring 214 may be compressed as the nut 206 moves towards the smooth portion 204 of the screw 202. The spring 214 may expand as nut 206 moves towards the stopper 210 mounted on the threaded portion 212 of the screw 202. Once nut 206 has made it to the smooth portion 204 of the screw 202, it may compress the spring 214 and then nut 206 will rotate freely. This serves as a safety measure as it prevents any function other than the nut 206 spinning freely. Thereby a user cannot over spin the screw 202. The compression or expansion of the spring 214 occurs as the tie rod puller 10 is being operated. Also mounted to the clutch assembly housing 220 may be plate 224. This alternate embodiment may serve to speed up the manufacturing process as the clutch assembly 200 may be built into the clutch assembly housing 220.

Figure 11:
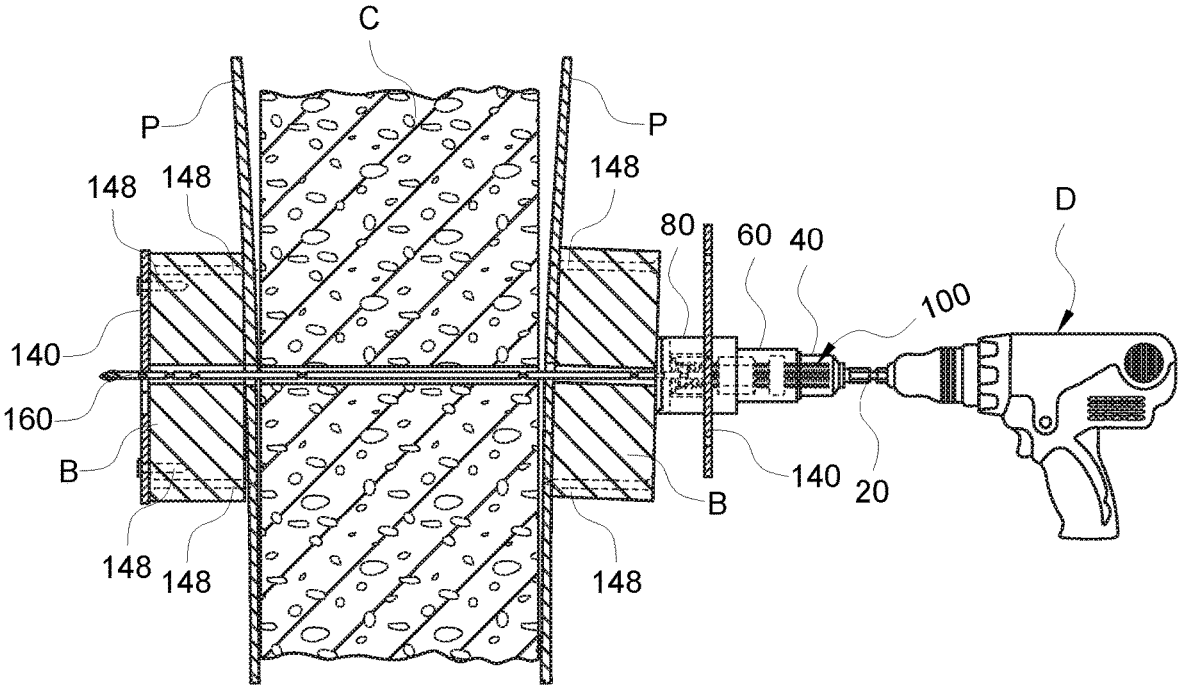
FIG. 11 exemplarily shows the tie rod puller before it has pulled a tie rod by automatic means and before a key plate has been mounted.
Figure 11A:
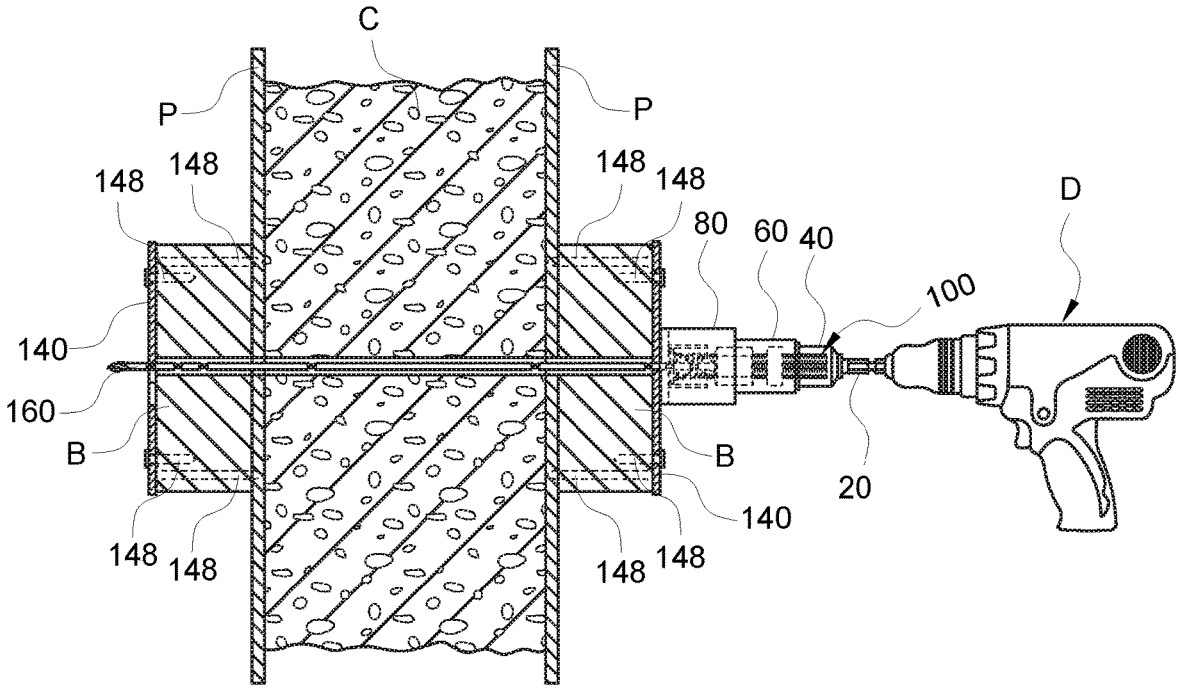
FIG. 11A exemplarily shows the tie rod puller having pulled a tie rod and a key plate having secured the tie rod.

Referring to FIG. 11 and FIG. 11A it can be seen how the tie rod puller 10 functions. In FIG. 11 it can be seen that there is the tie rod 160, a concrete form C, a pair of panels P, a pair of wooden blocks B, two of key plate 140, the tie rod puller 160 and a drill D, preferably an impact drill, shown in the example view of operation of the tie rod puller 10. Tie rod 160 has already been inserted into the concrete form C and into the pair of wooden blocks B on both exterior sides of the pair of panels P. On an opposite end, wherein the tie rod 160 exits and more specifically where the bit portion 166 of the tie rod 160 exits from one of the pair wooden blocks B, a key plate 140 is mounted to the wooden blocks B through the use of nails such as nails 148. The concrete form C is poured in between the pair of panels P. Those pair of panels P are however not tightly fitted up against the concrete form C. Hence there is a need to use the tie rod puller 10 to ensure that the panels are securely and properly mounted. On one of the sides, more specifically the side where there is one of the pair of wooden blocks B without a key plate 140 mounted thereon, it can be seen that the tie rod puller 10 with a key plate 140 mounted thereon is to be operated by the drill D which may preferably be an impact drill. The tie rod puller 10 while partially holding a tie rod 160 is mounted adjacent to one of the pair of wooden blocks B ready to be operated. This is the situation and set up that may be seen before the tie rod puller 10 of the present invention is used. After the tie rod puller 10 has been operated and hence tie rod 160 pulled then it can be seen that the pair of panels P have been properly secured, as seen in FIG. 11A, thereby meaning construction has properly taken place. Additionally, it can be seen that the key plate 140 that was mounted onto the tie rod puller 10 is then mounted to the one of the pair of wooden blocks B that previously did not have a key plate 140 mounted thereon. This occurs until enough tie rods have been inserted into a structure. The pair of panels P are securely fitted right up against the concrete form C, meaning there are no gaps between the pair of panels P and the concrete form C. This helps to increase safety and the integrity of a building that is being constructed. Once the tie rod 160 has been pulled by the tie rod puller 10 then the present invention may be detached from the tie rod 160. Once enough tie rods have been inserted into a structure and this part of construction, where the pairs of panels in an entire structure have been secured, has been completed then can all of the pair of wooden blocks and all the key plates mounted can be removed. Lastly, the tie rod 160 can be broken at the weakened portions 164 to leave a portion of the tie rod 160 inserted into the concrete form.

It should be understood that the present invention is not to be limited by dimensions nor by materials. The present invention can be made of any suitable material such as metal, steel or the likes. The present invention can also be of any predetermined size. It should also be appreciated that the present invention is held together by known means in the art of construction tools. Thereby meaning components can be soldered together, screwed together or any other appropriate means.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A construction tool, more specifically a tie rod puller comprising:

a. a pull housing assembly having a first opening and a second opening;

b. a tie rod, said tie rod including notches, weakened portions and a bit portion;

c. a key plate, said key plate including nail holes, a hole and a slot;

d. a clutch assembly, said clutch assembly including a screw having a smooth portion and a threaded portion, a stopper mounted on said threaded portion, a nut movably mounted to said screw, a spring adapted to compress as said nut moves down said screw or expand as said nut moves up said screw, and an opening adapted to receive said tie rod, said spring is mounted around the circumference of said smooth portion of said screw;

e. a clutch assembly housing, said clutch assembly housing including a clutch assembly housing opening on a distal end, a top opening and a plate on an opposite distal end, said plate includes a tie rod slot and a magnet adapted to receive and hold said key plate, said clutch assembly is partially housed in said clutch assembly housing, said clutch assembly housing and said clutch assembly are further partially housed in said pull housing;

f. a screw receiver adapted to receive said threaded portion of said screw of said clutch assembly; and g. brackets, wherein said brackets are mounted to said pull housing on a distal end.

2. The tie rod puller of claim 1, wherein said tie rod puller further includes a socket adapter, said socket adapter is mounted to said screw receiver.

3. The tie rod puller of claim 2, wherein said tie rod puller is operable via manual means such as with a manual drill or a ratchet attached to said socket adapter.

4. The tie rod puller of claim 2, wherein said tie rod puller is operable via automatic means such as with an impact drill attached to said socket adapter.

5. The tie rod puller of claim 1, wherein said tie rod puller is made of any suitable materials.

6. The tie rod puller of claim 1, wherein said key plate is further secured to a wall with nails inserted into said nail holes.

7. The tie rod puller of claim 1, wherein said screw protrudes from said clutch assembly housing opening of said clutch assembly housing.

8. The tie rod puller of claim 1, wherein said screw of said clutch assembly protrudes from said pull housing through said second opening of said pull housing when said screw of said clutch assembly and said clutch assembly housing are partially housed in said pull housing.

9. The tie rod puller of claim 1, wherein said brackets are mounted to said pull housing with fasteners.

10. The tie rod puller of claim 1, wherein said screw receiver further includes a spring tension pin hole adapted to receive a spring tension pin when said tie rod puller is fully assembled.

11. The tie rod puller of claim 1, wherein said clutch assembly further includes a clutch assembly spring tension pin hole adapted to receive a spring tension pin when said tie rod puller is fully assembled.

12. The tie rod puller of claim 1, wherein said nut of said clutch assembly rotates freely when it has reached said smooth portion of said screw of said clutch assembly.

13. The tie rod puller of claim 1, wherein said clutch assembly is integrated into said clutch assembly housing, thereby said clutch assembly is not removable from said clutch assembly housing.

* * * * *